US011694616B2

(12) United States Patent
Zhou et al.

(10) Patent No.: US 11,694,616 B2
(45) Date of Patent: Jul. 4, 2023

(54) ORGANIC LIGHT-EMITTING DISPLAY PANEL AND DRIVING METHOD

(71) Applicant: SEEYA OPTRONICS CO., LTD., Shanghai (CN)

(72) Inventors: Zhiwei Zhou, Shanghai (CN); Dong Qian, Shanghai (CN); Yongcai Shen, Shanghai (CN); Jialing Li, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/641,272

(22) PCT Filed: Mar. 26, 2021

(86) PCT No.: PCT/CN2021/083265
§ 371 (c)(1),
(2) Date: Mar. 8, 2022

(87) PCT Pub. No.: WO2022/037066
PCT Pub. Date: Feb. 24, 2022

(65) Prior Publication Data

US 2022/0310007 A1 Sep. 29, 2022

(30) Foreign Application Priority Data

Aug. 21, 2020 (CN) ..... 202010849008.0

(51) Int. Cl.
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2300/0426* (2013.01);
(Continued)

(58) Field of Classification Search
None
See application file for complete search history.

(56) References Cited

U.S. PATENT DOCUMENTS

2016/0005384 A1* 1/2016 Yoon ..... G09G 3/3291 345/82
2016/0211315 A1 7/2016 Kasai
(Continued)

FOREIGN PATENT DOCUMENTS

CN 1417767 5/2003
CN 1677473 10/2005
(Continued)

OTHER PUBLICATIONS

International Search Report dated Jun. 10, 2021 for Corresponding PCT Application No. PCT/CN2021/083265.
First Search Report Issued for CN 202010849008.

*Primary Examiner* — Christopher J Kohlman
(74) *Attorney, Agent, or Firm* — Duane Morris LLP

(57) ABSTRACT

Provided is an organic light-emitting display panel. Pixel-driving circuits of subpixels in a same row of pixel units are connected to a same light emission control signal line. The pixel-driving circuits of the subpixels in the same row of pixel units are connected to a same reset control signal line; and an anode of a light-emitting element of each of the subpixels to which the pixel-driving circuits electrically connected to the reset control signal line belong is at a reset voltage. In a display period of each frame of image, in at least part of a period during which an i-th row of pixel units are in a light emission stage, anodes of light-emitting elements of a j-th row of pixel units are at a reset voltage; and the j-th row of pixel units and the i-th row of pixel units are adjacent two rows of pixel units.

20 Claims, 13 Drawing Sheets

(52) U.S. Cl.
CPC ..... *G09G 2300/0452* (2013.01); *G09G 2300/0842* (2013.01); *G09G 2300/0861* (2013.01); *G09G 2310/0202* (2013.01); *G09G 2310/0286* (2013.01); *G09G 2310/08* (2013.01); *G09G 2320/0209* (2013.01); *G09G 2330/025* (2013.01)

(56) References Cited

U.S. PATENT DOCUMENTS

| | | | | |
|---|---|---|---|---|
| 2019/0341002 | A1* | 11/2019 | Kimura | G09G 3/2074 |
| 2019/0371236 | A1 | 12/2019 | Sakai | |
| 2020/0175924 | A1 | 6/2020 | Bang et al. | |

FOREIGN PATENT DOCUMENTS

| | | |
|---|---|---|
| CN | 101739954 | 6/2010 |
| CN | 102110410 | 6/2011 |
| CN | 103003864 | 3/2013 |
| CN | 103168324 | 6/2013 |
| CN | 103915061 | 7/2014 |
| CN | 104620307 | 5/2015 |
| CN | 106663407 | 5/2017 |
| CN | 106710529 | 5/2017 |
| CN | 106920513 | 7/2017 |
| CN | 108281461 | 7/2018 |
| CN | 108648708 | 10/2018 |
| CN | 110189702 | 8/2019 |
| CN | 110689833 | 1/2020 |
| CN | 111276094 | 6/2020 |
| CN | 111833816 | 10/2020 |
| CN | 111968576 | 11/2020 |
| JP | 2011145622 | 7/2011 |
| KR | 20070109674 | 11/2007 |
| WO | 2019/112683 | 6/2019 |

* cited by examiner

ORGANIC LIGHT-EMITTING DISPLAY PANEL AND DRIVING METHOD

CROSS-REFERENCES TO RELATED APPLICATIONS

This application is a national stage application filed under 35 U.S.C. 371 based on International Patent Application No. PCT/CN2021/083265, filed on Mar. 26, 2021, which claims priority to Chinese Patent Application No. 202010849008.0 filed on Aug. 21, 2020, the disclosures of which are incorporated herein by reference in their entireties.

TECHNICAL FIELD

The present application relates to display technologies, for example, to an organic light-emitting display panel and a driving method.

BACKGROUND

In recent years, organic light-emitting display panels have gradually become the mainstream for mobile display terminal screens and medium-and-large-sized display screens. An organic light-emitting display panel includes multiple subpixels arranged in an array. Each subpixel includes a pixel-driving circuit and a light-emitting element electrically connected to the pixel-driving circuit.

In the related art, each light-emitting element includes an anode, a hole auxiliary transport layer, a light-emitting layer, an electron auxiliary transport layer and a cathode which are stacked. To increase the density of subpixels or to prepare relatively-small-sized display panels, each of a hole auxiliary transport layer, a light-emitting layer and an electron auxiliary transport layer of light-emitting elements with different colors is an integral film layer, and each of the hole auxiliary transport layer, the light-emitting layer and the electron auxiliary transport layer of the light-emitting elements is not divided. Since each of a hole auxiliary transport layer, a light-emitting layer and an electron auxiliary transport layer of adjacent light-emitting elements is an integral film layer, when a certain light-emitting element emits light, holes injected from an anode of the light-emitting element may be partially transmitted to an adjacent light-emitting element through the hole auxiliary transport layer, so that a transverse leakage current is generated. The leakage current affects the signal voltage of the adjacent light-emitting element, thereby leading to blurring and color mixing of images.

SUMMARY

The present application provides an organic light-emitting display panel and a driving method, so as to avoid the problem that a leakage current generated between adjacent light-emitting elements affects the display effect.

In a first aspect, an embodiment of the present application provides an organic light-emitting display panel. The organic light-emitting display panel includes a plurality of pixel units, each of the plurality of pixel units includes a plurality of subpixels with different colors; each of the plurality of subpixels includes a pixel-driving circuit and a light-emitting element electrically connected to the pixel-driving circuit; the light-emitting element includes a common layer; and common layers of adjacent light-emitting elements are disposed in a same layer and connected to each other.

For at least part of subpixel columns, adjacent two subpixels in a column direction emit different colors.

pixel-driving circuits of subpixels in a same row of pixel units are connected to a same light emission control signal line; and in a case where the light emission control signal line transmits an effective light emission control pulse, the subpixels to which the pixel-driving circuits electrically connected to the light emission control signal line belong are in a light emission stage.

The pixel-driving circuits of the subpixels in the same row of pixel units are connected to a same reset control signal line; and in a case where the reset control signal line transmits an effective reset pulse, an anode of a light-emitting element of each of the subpixels to which the pixel-driving circuits electrically connected to the reset control signal line belong is at a reset voltage, and the subpixels to which the pixel-driving circuits electrically connected to the reset control signal line belong are in a non-light-emission stage.

In a display period of each frame of image, in at least part of a period during which an i-th row of pixel units are in a light emission stage, anodes of light-emitting elements of a j-th row of pixel units are at the reset voltage to lead out a leakage current, where the leakage current is generated by the i-th row of pixel units through the common layer, where i and j are each a positive integer greater than or equal to 1, and the j-th row of pixel units and the i-th row of pixel units are adjacent two rows of pixel units.

In a second aspect, an embodiment of the present application further provides a driving method of an organic light-emitting display panel. The driving method includes steps described below.

In at least part of a light emission stage of an i-th row of pixel units, a potential of a light emission control signal line of the i-th row of pixel units is controlled to be a first level, a potential of a light emission control signal line of a j-th row of pixel units is controlled to be a second level, a potential of a reset control signal line of the i-th row of pixel units is controlled to be a third level, and a potential of a reset control signal line of the j-th row of pixel units is controlled to be a fourth level to enable anodes of light-emitting elements of the j-th row of pixel units to be at a reset voltage and the j-th row of pixel units to be in a non-light-emission stage, so as to lead out a leakage current, where the leakage current is generated by the i-th row of pixel units through a common layer.

i and j are each a positive integer greater than or equal to 1, and the j-th row of pixel units and the i-th row of pixel units are adjacent two rows of pixel units; the first level is an effective light emission control pulse; the second level is an ineffective light emission control pulse; the third level is an effective reset control pulse; and the fourth level is an ineffective reset control pulse.

According to the organic light-emitting display panel provided by the embodiment of the present application, pixel-driving circuits of subpixels in a same row of pixel units are connected to a same light emission control signal line; and in a case where the light emission control signal line transmits an effective light emission control pulse, the subpixels to which the pixel-driving circuits electrically connected to the light emission control signal line belong are in a light emission stage. The pixel-driving circuits of the subpixels in the same row of pixel units are connected to a same reset control signal line; and in a case where the reset control signal line transmits an effective reset pulse, an anode of a light-emitting element of each of the subpixels to which the pixel-driving circuits electrically connected to the reset control signal line belong is at a reset voltage, and the subpixels to which the pixel-driving circuits electrically connected to the reset control signal line belong are in a non-light-emission stage. For at least part of subpixel columns, adjacent two subpixels in a column direction emit different colors. Therefore, in a display period of each frame of image, in at least part of a period during which an i-th row of pixel units are in a light emission stage, anodes of light-emitting elements of a j-th row of pixel units are controlled to be at a reset voltage; and the j-th row of pixel units and the i-th row of pixel units are adjacent two rows of pixel units, so that the problem is solved of crosstalk caused by a leakage current between adjacent subpixels with different colors in the column direction.

DETAILED DESCRIPTION

Figure 1:
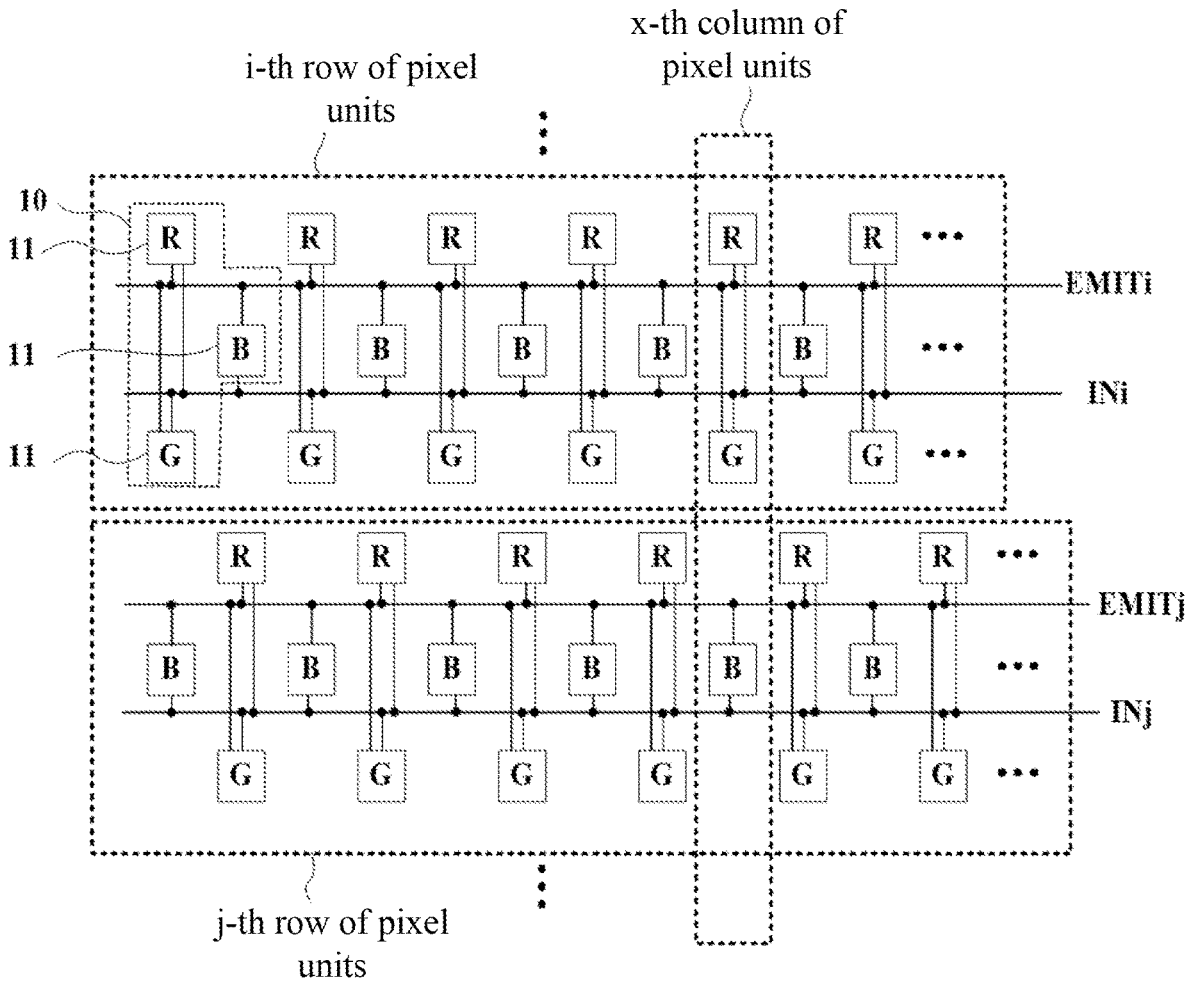
FIG. 1 is a structural diagram of an organic light-emitting display panel according to an embodiment of the present application.

The embodiment of the present application provides an organic light-emitting display panel. The organic light-emitting display panel includes multiple pixel units, and each of the multiple pixel units includes multiple subpixels with different colors for achieving color display. Each of the multiple subpixels includes a pixel-driving circuit and a light-emitting element electrically connected to the pixel-driving circuit. The pixel-driving circuit is configured to drive the electrically connected light-emitting element to emit light. The light-emitting element includes a common layer; and common layers of adjacent light-emitting elements are disposed in a same layer and connected to each other. That is, the common layer is an integral film layer without interruption between light-emitting elements. The common layer may include, for example, at least one of a hole auxiliary transport layer, a light-emitting layer or an electron auxiliary transport layer.

For at least part of subpixel columns, adjacent two subpixels in a column direction emit different colors. pixel-driving circuits of subpixels in a same row of pixel units are connected to a same light emission control signal line; and in a case where the light emission control signal line transmits an effective light emission control pulse, the subpixels to which the pixel-driving circuits electrically connected to the light emission control signal line belong are in a light emission stage.

The pixel-driving circuits of the subpixels in a same row of pixel units are connected to a same reset control signal line; and in a case where the reset control signal line transmits an effective reset pulse, an anode of a light-emitting element of each of the subpixels to which the pixel-driving circuits electrically connected to the reset control signal line belong is at a reset voltage, and the subpixels to which the pixel-driving circuits electrically connected to the reset control signal line belong are in a non-light-emission stage.

In a display period of each frame of image, in at least part of a period during which an i-th row of pixel units are in a light emission stage, anodes of light-emitting elements of a j-th row of pixel units are at the reset voltage to lead out a leakage current, where the leakage current is generated by the i-th row of pixel units through the common layer, i and j are each a positive integer greater than or equal to 1, and the j-th row of pixel units and the i-th row of pixel units are adjacent two rows of pixel units.

That is, in at least part of a period during which an i-th row of pixel units are in a light emission stage, anodes of light-emitting elements of a j-th row of pixel units adjacent to the i-th row of pixel units are at a reset voltage. The anodes are reset, and the light-emitting elements do not emit light. Therefore, if a subpixel with a certain color of the i-th row of pixel units emitting light generates a leakage current to a subpixel with a different color of the adjacent j-th row of pixel units, the leakage current can be led out due to the reset voltage of the anodes of the light-emitting elements of subpixels of the j-th row of pixel units, so that crosstalk between subpixels with different colors can be avoided.

FIG. 1 is a structural diagram of an organic light-emitting display panel according to an embodiment of the present application. As shown in FIG. 1, the organic light-emitting display panel includes multiple pixel units 10, and each pixel unit 10 includes multiple subpixels 11 with different colors. In FIG. 1, exemplarily, each pixel unit 10 includes a red subpixel R, a green subpixel G and a blue subpixel B. Each subpixel 11 includes a pixel-driving circuit and a light-emitting element (not shown in FIG. 1) electrically connected to the pixel-driving circuit.

pixel-driving circuits of subpixels in a same row of pixel units are connected to a same light emission control signal line; and in a case where the light emission control signal line transmits an effective light emission control pulse, the subpixels to which the pixel-driving circuits electrically connected to the light emission control signal line belong are in a light emission stage. As shown in FIG. 1, pixel-driving circuits of subpixels in an i-th row of pixel units are connected to the same light emission control signal line EMITi. The pixel-driving circuits of the subpixels in the i-th row of pixel units are connected to the same reset control signal line INi. pixel-driving circuits of subpixels in a j-th row of pixel units are connected to the same light emission control signal line EMlTj. The pixel-driving circuits of the subpixels in the j-th row of pixel units are connected to the same reset control signal line INj. i and j are row numbers of pixel units, i and j are both positive integers greater than or equal to 1, and the j-th row of pixel units and the i-th row of pixel units are adjacent two rows of pixel units.

For example, if an x-th column of subpixels exist, in a column direction, adjacent two subpixels in a column direction emit different colors. x is a positive integer greater than or equal to 1. Exemplarily, adjacent two subpixels in the x-th column of subpixels are a green subpixel G and a blue subpixel B respectively. In a display period of each frame of image, in at least part of a period during which the i-th row of pixel units are in a light emission stage, anodes of light-emitting elements of the j-th row of pixel units are at a reset voltage.

The x-th column subpixel of the i-th row of pixel units emits light, and an anode of light-emitting element of the x-th column subpixel of the j-th row of pixel units is at a reset voltage and does not emit light. Referring to FIG. 1, the green subpixel G, that is, the x-th column subpixel of the i-th row of pixel units is adjacent to the blue subpixel B, that is, the x-th column subpixel of the j-th row of pixel units. When the green subpixel G, the x-th column subpixel of the i-th row of pixel units emits light, part of holes injected from the anode of the green subpixel G are transmitted to the blue subpixel B, the x-th column subpixel of the j-th row of pixel units adjacent to the green subpixel G. Since the anode of the light-emitting element of the blue subpixel B is at a reset voltage, a leakage current can be led out, avoiding the problem of crosstalk between subpixels with different colors.

Optionally, in the embodiment of the present application, in a display period of each frame of image, light emission stages of adjacent two rows of pixel units may be controlled not to overlap. To achieve good display effects, optionally, in the embodiment of the present application, in a display period of each frame of image, light emission stages of adjacent two rows of pixel units are controlled not to overlap. Therefore, in the entire light emission stage of subpixels of the i-th row of pixel units, subpixels of the j-th row of pixel units do not emit light, and anodes of light-emitting elements of the subpixels of the j-th row of pixel units are at a reset voltage, so that in the column direction, the problem is avoided of crosstalk caused by a leakage current between adjacent two subpixels with different colors in an entire light emission stage.

The arrangement of subpixels in FIG. 1 is merely a specific example provided by the present application, and is not intended to limit the embodiment of the present application. In other implementations, other forms of pixel arrangement may be selected according to design requirements of the product, as long as for at least part of subpixel columns, adjacent two subpixels in the column direction emit different colors.

Figure 2:
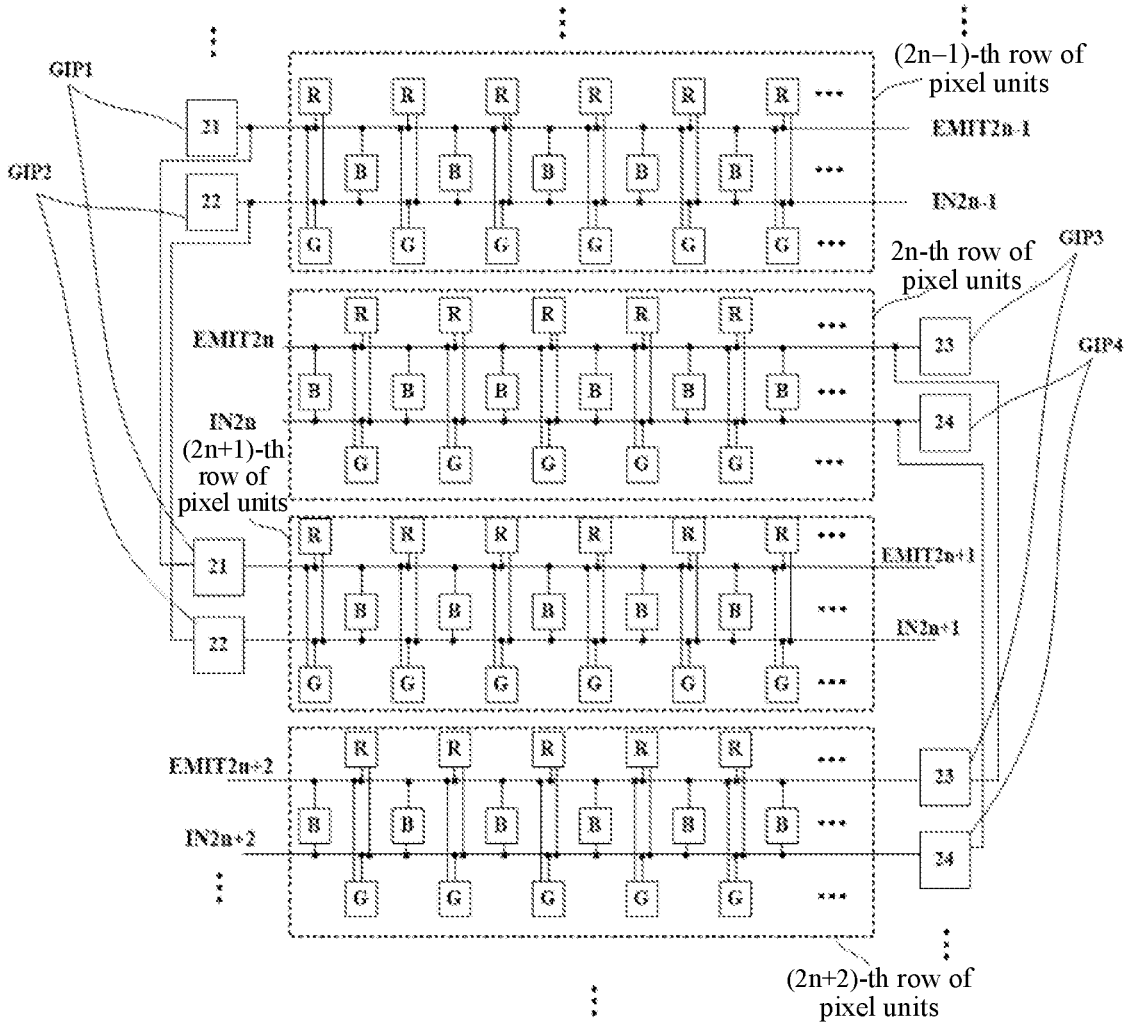
FIG. 2 is a structural diagram of another organic light-emitting display panel according to an embodiment of the present application.

FIG. 2 is a structural diagram of an organic light-emitting display panel according to an embodiment of the present application. As shown in FIG. 2, optionally, the organic light-emitting display panel provided by the embodiment of the present application further includes a first scan driver circuit GIP1, a second scan driver circuit GIP2, a third scan driver circuit GIP3 and a fourth scan driver circuit GIP4. The first scan driver circuit GIP1 includes multiple cascaded first shift registers 21; the second scan driver circuit GIP2 includes multiple cascaded second shift registers 22; the third scan driver circuit GIP3 includes multiple cascaded third shift register 23; and the fourth scan driver circuit GIP4 includes multiple cascaded fourth shift registers 24.

Light emission control signal lines (in FIG. 2, the light emission control signal line EMIT2*n*−1 and the light emission control signal line EMIT2*n*+1 are exemplarily drawn) corresponding to odd rows of pixel units are electrically connected to the multiple cascaded first shift registers 21 in one-to-one correspondence; reset control signal lines (in FIG. 2, the reset control signal line IN2*n*−1 and the reset control signal line IN2*n*+1 are exemplarily drawn) corresponding to the odd rows of pixel units are electrically connected to the multiple cascaded second shift registers 22 in one-to-one correspondence; light emission control signal lines (in FIG. 2, the light emission control signal line EMIT2*n* and the light emission control signal line EMIT2*n*+2 are exemplarily drawn) corresponding to even rows of pixel units are electrically connected to the multiple cascaded third shift registers 23 in one-to-one correspondence; and reset control signal lines (in FIG. 2, the reset control signal line IN2*n* and the reset control signal line IN2*n*+2 are exemplarily drawn) corresponding to the even rows of pixel units are electrically connected to the multiple cascaded fourth shift registers 24 in one-to-one correspondence.

The light emission control signal lines connected to the odd rows of pixel units which are connected to the first scan driver circuit GIP1 provide light emission control signals row by row; the reset control signal lines connected to the odd rows of pixel units which are connected to the second scan driver circuit GIP2 provide reset control signals row by row; the light emission control signal lines connected to the even rows of pixel units which are connected to the third scan driver circuit GIP3 provide light emission control signals row by row; and the reset control signal lines connected to the even rows of pixel units which are connected to the fourth scan driver circuit GIP4 provide reset control signals row by row.

Figure 3:
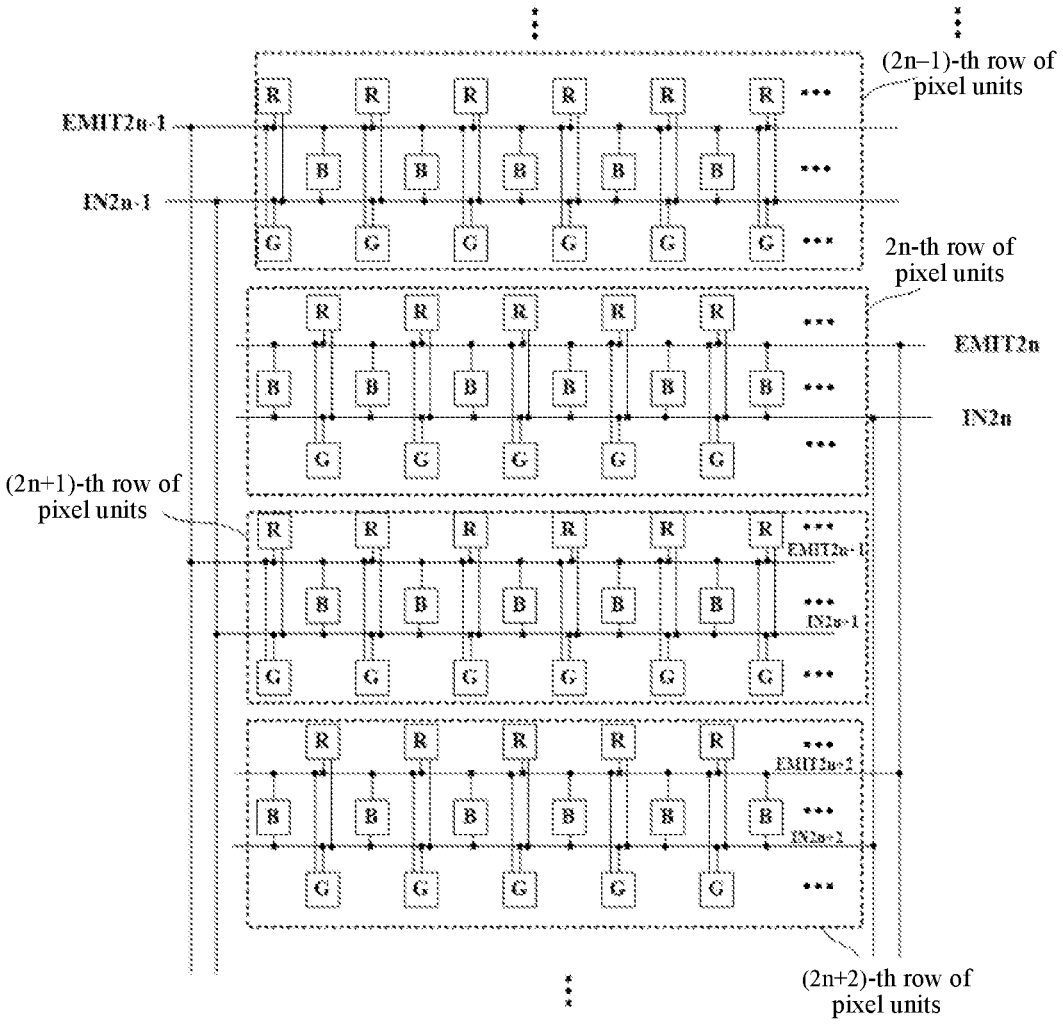
FIG. 3 is a structural diagram of another organic light-emitting display panel according to an embodiment of the present application.

FIG. 3 is a structural diagram of an organic light-emitting display panel according to an embodiment of the present application. As shown in FIG. 3, light emission control signal lines (in FIG. 3, the light emission control signal line EMIT2*n*−1 and the light emission control signal line EMIT2*n*+1 are exemplarily drawn) corresponding to odd rows of pixel units are electrically connected to each other; light emission control signal lines (in FIG. 3, the light emission control signal line EMIT2*n* and the light emission control signal line EMIT2*n*+2 are exemplarily drawn) corresponding to even rows of pixel units are electrically connected to each other; reset control signal lines (in FIG. 3, the reset control signal line IN2*n*−1 and the reset control signal line IN2*n*+1 are exemplarily drawn) corresponding to the odd rows of pixel units are electrically connected to each other; and reset control signal lines (in FIG. 3, the reset control signal line IN2*n* and the reset control signal line IN2*n*+2 are exemplarily drawn) corresponding to the even rows of pixel units are electrically connected to each other. In the display period of each frame of image, the odd rows of pixel units emit light simultaneously; and the even rows of pixel units emit light simultaneously.

Figure 4:
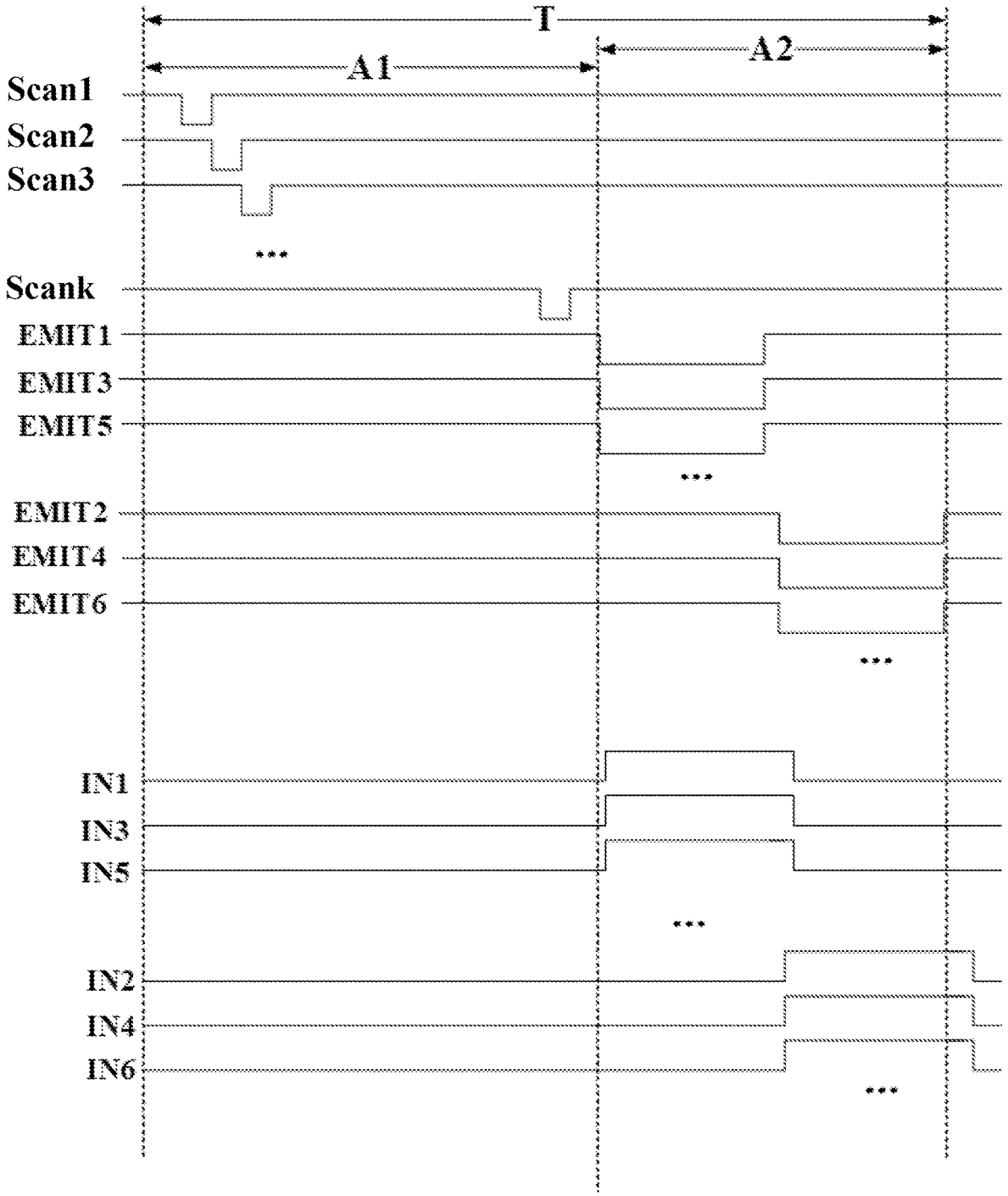
FIG. 4 is a driving timing diagram of an organic light-emitting display panel according to an embodiment of the present application.

FIG. 4 is a driving timing diagram of an organic light-emitting display panel according to an embodiment of the present application. As shown in FIG. 4, in a display period T of each frame of image, the odd rows of pixel units emit light simultaneously; and the even rows of pixel units emit light simultaneously. Referring to FIG. 4, a light emission control stage A2 of a display period T of each frame of image includes two portions, an odd-row light emission control stage and an even-row light emission control stage, respectively.

In the odd-row light emission control stage, the light emission control signal line (EMIT1, EMIT3, EMIT5) corresponding to each odd row of pixel units transmits an effective light emission control pulse (in FIG. 4, the effective light emission control pulse is exemplarily set to a low level); the light emission control signal line (EMIT2, EMIT4, EMIT6) corresponding to each even row of pixel units transmits an ineffective light emission control pulse (in FIG. 4, the ineffective light emission control pulse is exemplarily set to a high level), light-emitting elements of subpixels of each even row of pixel units do not emit light, the reset control signal line (IN2, IN4, IN6) corresponding to each even row of pixel units transmits an effective reset pulse, and anodes of light-emitting elements of subpixels of each even row of pixel units are at a reset voltage. In the even-row light emission control stage, the light emission control signal line (EMIT2, EMIT4, EMIT6) corresponding to each even row of pixel units transmits an effective light emission control pulse (in FIG. 4, the effective light emission control pulse is exemplarily set to a low level), and light-emitting elements of subpixels of each even row of pixel units emit light. The light emission control signal line (EMIT1, EMIT3, EMIT5) corresponding to each odd row of pixel units transmits an ineffective light emission control pulse (in FIG. 4, the ineffective light emission control pulse is exemplarily set to a high level), and light-emitting elements of subpixels of each odd row of pixel units do not emit light. The reset control signal line (IN11, IN3, IN5) corresponding to each odd row of pixel units transmits an effective reset pulse, and anodes of light-emitting elements of subpixels of each odd row of pixel units are at a reset voltage.

On the basis of the above embodiments, optionally, a display period T of each frame of image includes a data writing stage A1 and a light emission control stage A2. In the data writing stage A1 of the display period T of each frame of image, a plurality of rows of pixel units sequentially perform data writing; and after the data writing stage A1 of the display period T of each frame of image ends, the light emission control stage A2 is performed. In the light emission control stage A2, the odd rows of pixel units emit light simultaneously, and the even rows of pixel units emit light simultaneously. For example, referring to FIG. 4, in the data writing stage A1 of a display period T of each frame of image, data writing is performed by full screen scanning. In FIG. 4, Scank refers to a scan signal corresponding to each subpixel of a k-th row of pixel units, and k is a positive integer.

Optionally, the light emission control stage A2 of the display period of each frame of image may be set to include multiple light emission control substages. In each of the multiple light emission control substages, the odd rows of pixel units emit light simultaneously, and the even rows of pixel units emit light simultaneously.

Figure 5:
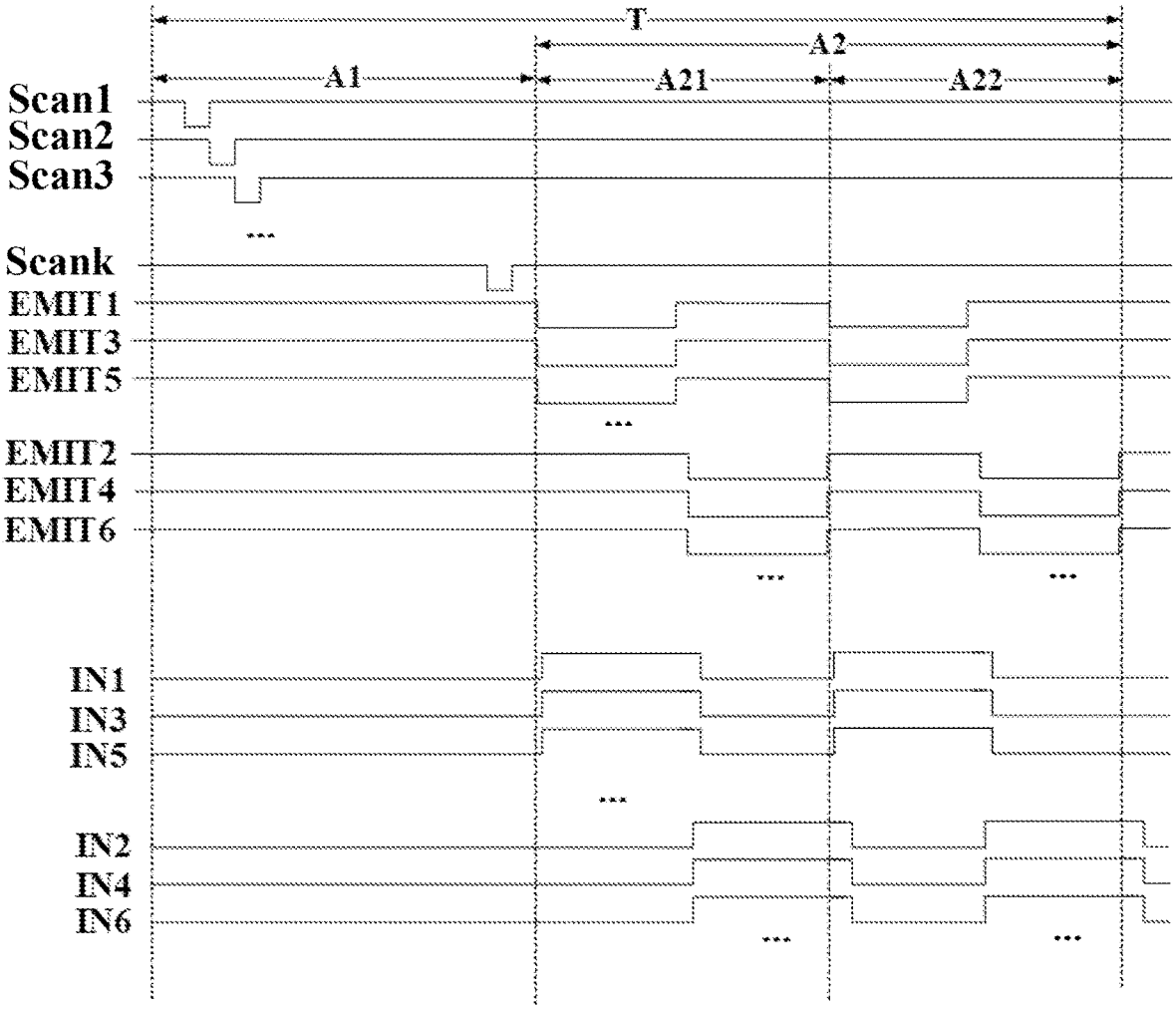
FIG. 5 is a driving timing diagram of another organic light-emitting display panel according to an embodiment of the present application.

FIG. 5 is a driving timing diagram of another organic light-emitting display panel according to an embodiment of the present application. Referring to FIG. 5, exemplarily, the light emission control stage A2 of a display period of each frame of image includes two light emission control substages, a light emission control substage A21 and a light emission control substage A22, respectively. In each light emission control substage, all of the odd rows of pixel units emit light simultaneously, and all of the even rows of pixel units emit light simultaneously. In the same light emission control substage, in at least part of a period during which an i-th row of pixel units are in a light emission stage, anodes of light-emitting elements of a j-th row of pixel units are at a reset voltage. The j-th row of pixel units and the i-th row of pixel units are adjacent two rows of pixel units.

Figure 6:
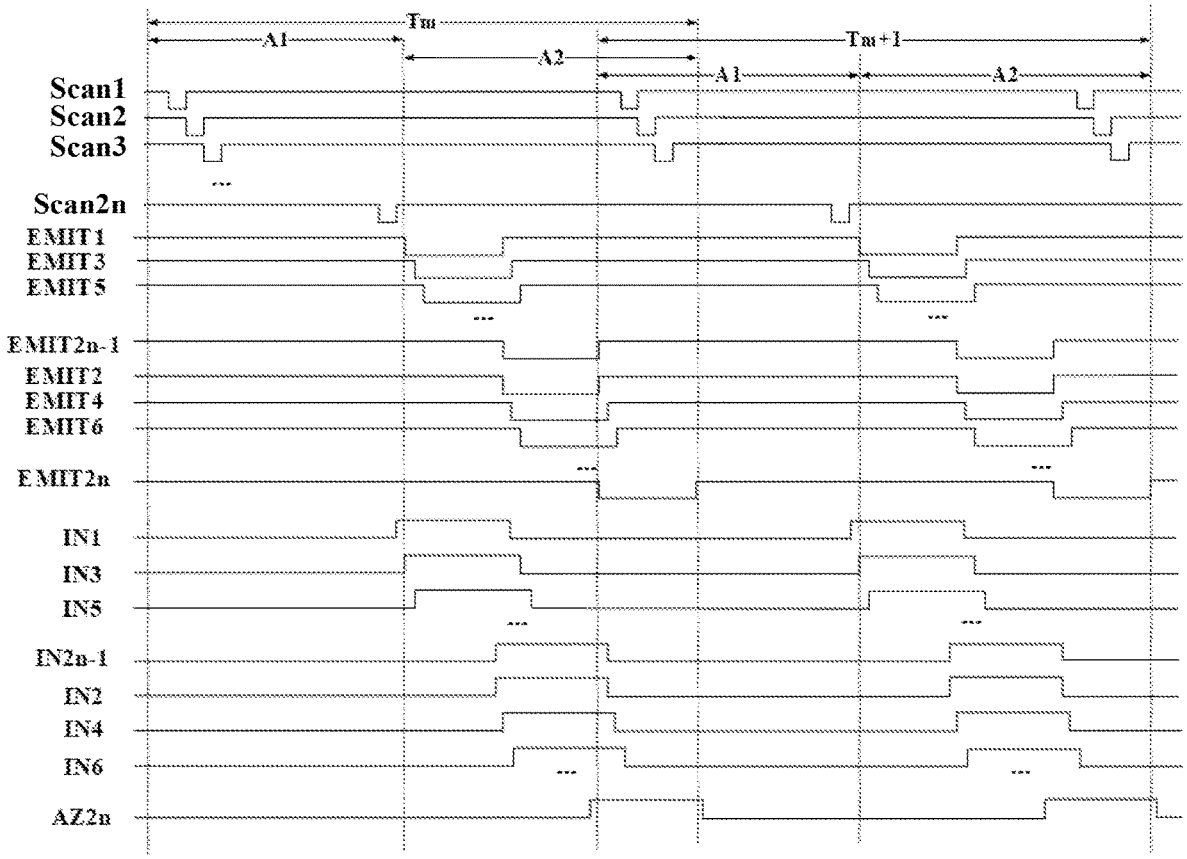
FIG. 6 is a driving timing diagram of another organic light-emitting display panel according to an embodiment of the present application.

FIG. 6 is a driving timing diagram of another organic light-emitting display panel according to an embodiment of the present application. According to the organic light-emitting display panel provided by the embodiment of the present application, it may be achieved that odd rows of pixel units emit light row by row, and even rows of pixel units emit light row by row; and light emission stages of adjacent two odd rows of pixel units overlap, and light emission stages of adjacent two even rows of pixel units overlap.

Optionally, on the basis of the above embodiments, a display period of each frame of image includes a data writing stage A1 and a light emission control stage A2. In the data writing stage A1 of the display period of each frame of image, a plurality of rows of pixel units sequentially perform data writing; and in the light emission control stage A2, the odd rows of pixel units emit light row by row, and the even rows of pixel units emit light row by row. The light emission stages of the adjacent two odd rows of pixel units overlap, and the light emission stages of the adjacent two even rows of pixel units overlap. For example, referring to FIG. 6, for the driving manner provided by the embodiment of the present application, in the data writing stage A1 of a display period of each frame of image, data writing is performed by full screen scanning first, and then in the light emission control stage A2, the odd rows of pixel units emit light row by row. The light emission stages of the adjacent two odd rows of pixel units overlap, and the light emission stages of the adjacent two even rows of pixel units overlap. FIG. 6 introduces an example in which an organic light-emitting display panel includes 2n rows of pixel units.

In the embodiment of the present application, it may be controlled that a light emission control stage of a display period of a previous frame of image overlaps a data writing stage of a display period of a next frame of image. For example, referring to FIG. 6, the light emission control stage A2 of the display period Tm of the previous fame of image overlaps the data writing stage A1 of the display period Tm+1 of the next frame of image. As shown in FIG. 6, in the light emission control stage, the odd rows of pixel units emit light row by row, the even rows of pixel units emit light row by row, and the light emission of the even rows of pixel units continues to the next frame. The light emission control stage of the even rows of pixel units overlaps the data writing stage of the next frame, so that the scanning input of a light emission control signal of the next frame is not affected.

Optionally, the light emission control stage of the display period of each frame of image includes multiple light emission control substages; and in each of the multiple light emission control substages, the even rows of pixel units emit light row by row, and the odd rows of pixel units emit light row by row. The light emission stages of the adjacent two odd rows of pixel units overlap, and the light emission stages of the adjacent two even rows of pixel units overlap.

Figure 7:
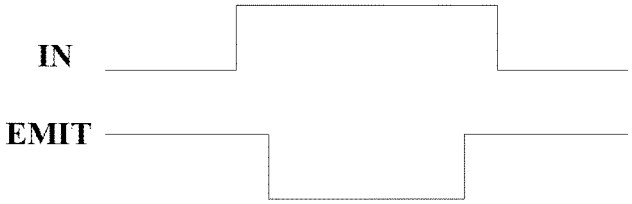
FIG. 7 is a driving timing diagram of a light emission control signal line and a reset control signal line of the same row of pixel units.

On the basis of the above embodiments, optionally, the light emission control signal line and the reset control signal line of the same row of pixel units satisfy that: the effective light emission control pulse of the light emission control signal line and the effective reset pulse of the reset control signal line do not overlap. FIG. 7 is a driving timing diagram of a light emission control signal line and a reset control signal line of the same row of pixel units. As shown in FIG. 7, the effective light emission control pulse (exemplarily a low level in FIG. 7) of the light emission control signal line EMIT and an effective reset pulse (exemplarily a low level in FIG. 7) of the reset control signal line IN do not overlap. That is, the effective reset pulse of the reset control signal line IN should be cut off first, and then the effective light emission control pulse of the light emission control signal line EMIT is controlled to input; after the effective light emission control pulse of the light emission control signal line EMIT is cut off, the effective reset pulse of the reset control signal line IN is input. In this way, it is avoided that the effective reset pulse of the reset control signal line IN overlaps the effective light emission control pulse of the light emission control signal line EMIT, causing a short circuit between a reset signal input terminal and a power signal terminal on the organic light-emitting display panel and the generation of a large current.

The specific circuit structure of the pixel-driving circuit of the organic light-emitting display panel is not limited in the embodiments of the present application, and several pixel-driving circuit structures that can achieve the beneficial effects of the present application are exemplarily provided below, but are not intended to limit the embodiments of the present application.

Figure 8:
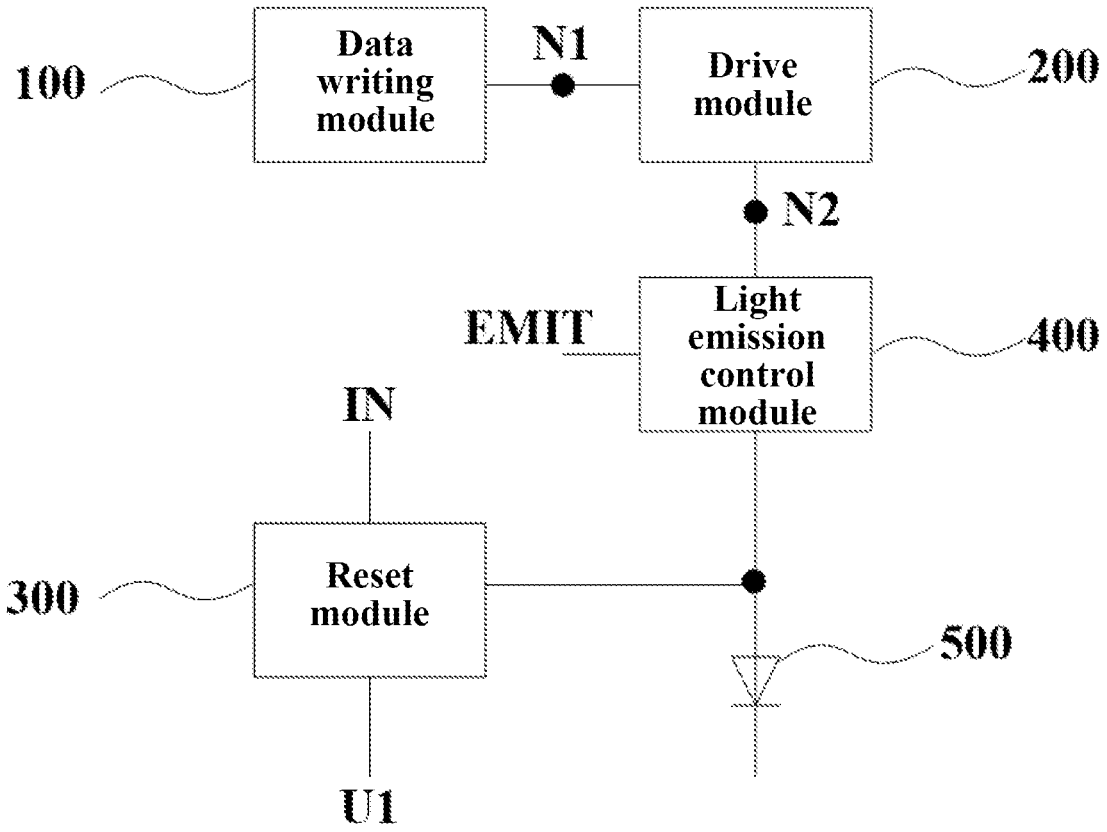
FIG. 8 is a structural diagram of a pixel-driving circuit according to an embodiment of the present application.

On the basis of the above embodiments, optionally, referring to FIG. 8, the pixel-driving circuit includes a data writing module 100, a drive module 200, a reset module 300 and a light emission control module 400.

The data writing module 100 and the drive module 200 are electrically connected to a first node N1; the drive module 200 and the light emission control module 400 are electrically connected to a second node N2; the reset module 300 and the light emission control module 400 are each electrically connected to an anode of the light-emitting element 500; the reset module 300 is electrically connected to a reset control signal line IN; and the light emission control module 400 is electrically connected to a light emission control signal line EMIT. The data writing module 100 is configured to provide a data signal to the first node N1; the drive module 200 is configured to drive the light-emitting element 500 to emit light in a case where the light emission control module 400 is turned on; and the reset module 300 is configured to provide a reset signal U1 to the anode of the light-emitting element when an effective reset pulse is input into the reset control signal line IN (for ease of description, the same reference numeral is used for representing the reset signal and the reset voltage).

Optionally, the light emission control module 400 may include a first transistor T1; the reset module 300 includes a second transistor T2; the first transistor T1 is an NMOS transistor, and the second transistor T2 is a PMOS transistor; or the second transistor T2 is an NMOS transistor, and the first transistor T1 is a PMOS transistor; and a light emission control signal line corresponding to each row of pixel units is also used as a reset control signal line.

Figure 9:
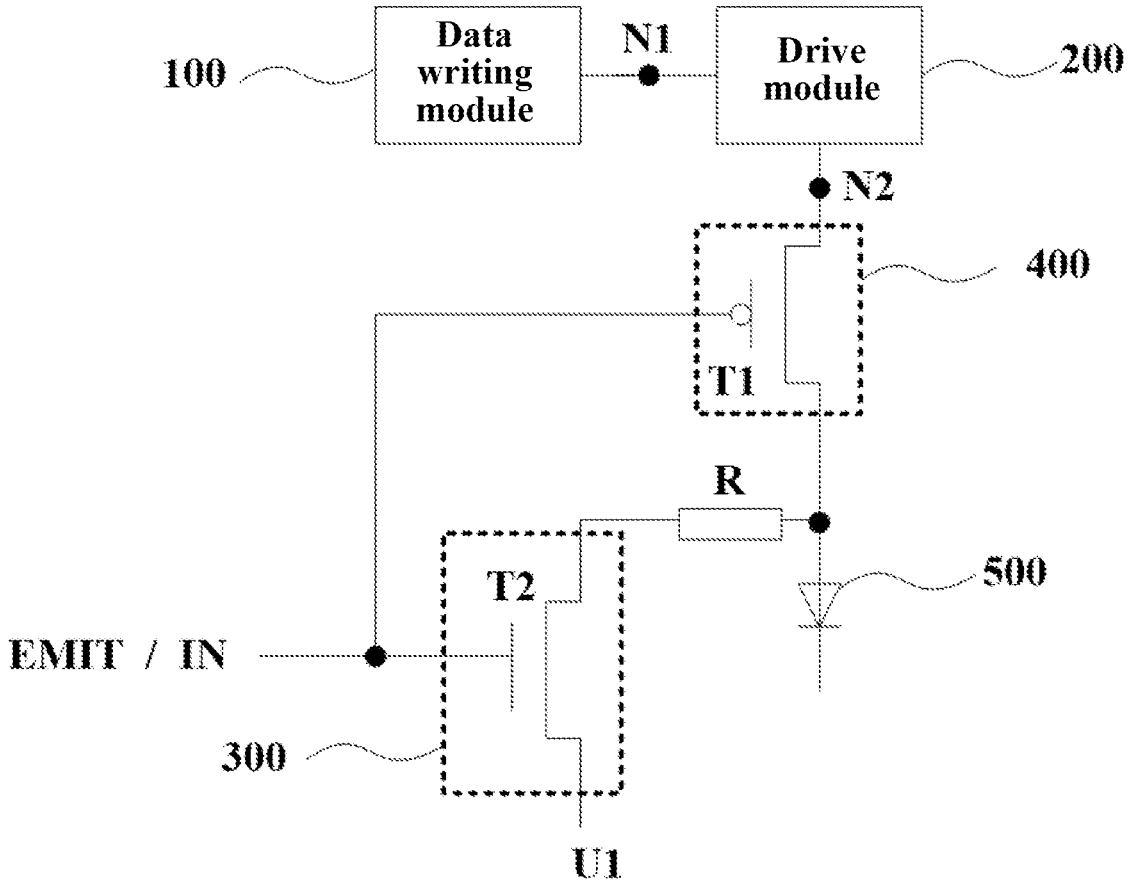
FIG. 9 is a structural diagram of another pixel-driving circuit according to an embodiment of the present application.

Referring to FIG. 9, the first transistor T1 is a PMOS transistor, the second transistor T2 is an NMOS transistor, and the first transistor T1 and the second transistor T2 use the same signal line, that is, the light emission control signal line EMIT corresponding to each row of pixel units is also used as the reset control signal line IN. In this way, the number of signal lines in the pixel-driving circuit can be reduced, and the number of scan driver circuits in the organic light-emitting display panel can be reduced. For example, the scanning input of the light emission control signal and the reset control signal may be performed by the same scan driver circuit.

On the basis of the above embodiments, optionally, a current limiting resistor R may be connected in series between the light emission control module 400 and the reset module 300, so as to prevent the first transistor T1 and the second transistor T2 from generating a large current at the moment of switching.

Figure 10:
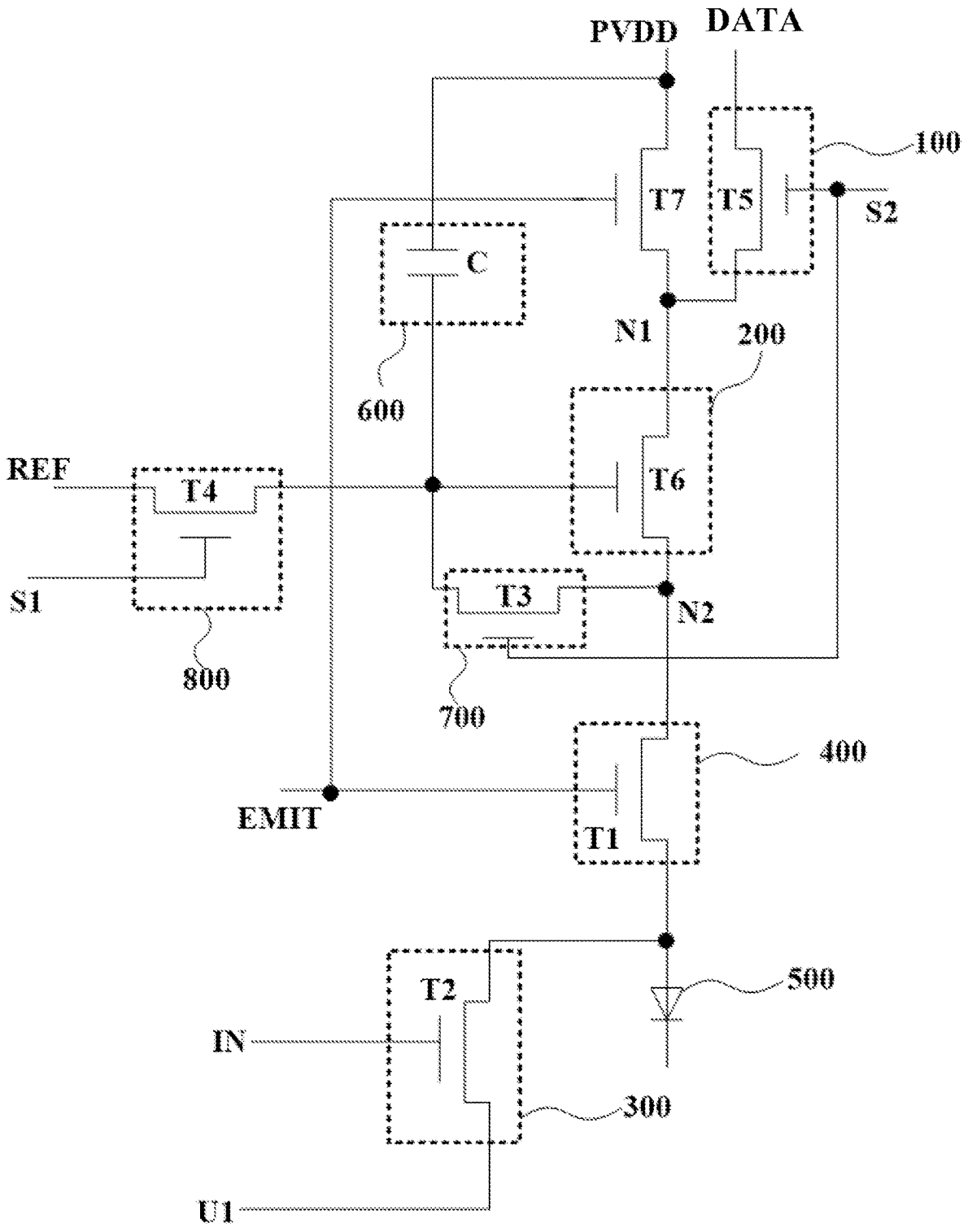
FIG. 10 is a structural diagram of another pixel-driving circuit according to an embodiment of the present application.

FIG. 10 is a structural diagram of another pixel-driving circuit according to an embodiment of the present application. As shown in FIG. 10, the pixel-driving circuit may further include a storage module 600, a threshold compensation module 700 and an initialization module 800. The storage module 600 includes a storage capacitor C, the threshold compensation module 700 includes a third transistor T3, and the initialization module 800 includes a fourth transistor T4. The data writing module 100 includes a fifth transistor T5, and the drive module 200 includes a sixth transistor T6. The pixel-driving circuit further includes a seventh transistor T7.

A control terminal of the third transistor T3 is electrically connected to a control terminal of the fifth transistor T5, a first electrode of the third transistor T3 is electrically connected to a first electrode plate of the capacitor C, a second electrode of the third transistor T3 and a second electrode of the sixth transistor T6 are both electrically connected to the second node N2, a first electrode of the sixth transistor T6 is electrically connected to the first node N1, a control terminal of the sixth transistor T6 is electrically connected to a second electrode of the fourth transistor T4, and a first electrode of the fourth transistor T4 is electrically connected to an initialization signal terminal REF. A second electrode plate of the capacitor C and a first electrode of the seventh transistor T7 are both electrically connected to a power signal terminal PVDD, a second electrode of the seventh transistor T7 and a second electrode of the fifth transistor T5 are both electrically connected to the first node N1, and a first electrode of the fifth transistor T5 is electrically connected to a data signal terminal DATA. A control terminal of the first transistor T1 and a control terminal of the seventh transistor T7 are both electrically connected to a light emission control signal terminal (into which a light emission control signal EMIT is input), a first electrode of the first transistor T1 is electrically connected to the second node N2, a second electrode of the first transistor T1 and a first electrode of the second transistor T2 are both electrically connected to the anode of the light-emitting element 500, a second electrode of the second transistor T2 is electrically connected to a reset signal input terminal (used for inputting the reset signal U1), and a control terminal of the second transistor T2 is electrically connected to a reset control signal terminal (used for inputting a reset control signal IN).

Optionally, the first electrode of the fourth transistor T4 may be electrically connected to the second electrode of the second transistor T2, that is, the initialization signal terminal is used as the reset signal input terminal. The reset signal U1 input into the reset signal input terminal is equivalent to an initialization potential REF for the initialization of the drive module.

The signal input into the reset signal input terminal may further be a zero potential, a ground potential GND, a cathode potential of the light-emitting element, a common negative potential VSS lower than the cathode potential of the light-emitting element, or a common low potential VGL used other circuits in the organic light-emitting display panel.

Figure 11:
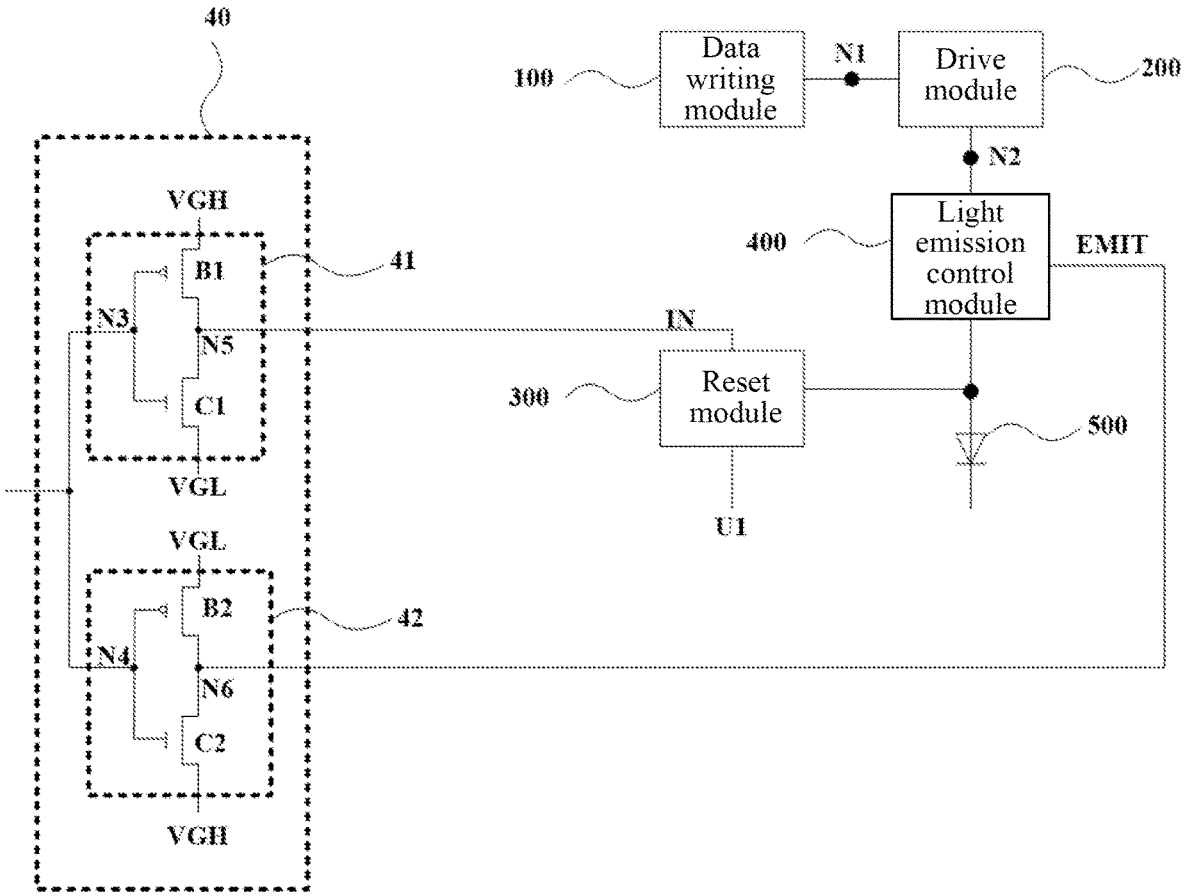
FIG. 11 is a partial structural diagram of another organic light-emitting display panel according to an embodiment of the present application.

FIG. 11 is a partial structural diagram of another organic light-emitting display panel according to an embodiment of the present application. As shown in FIG. 11, the organic light-emitting display panel provided by the embodiment of the present application further includes multiple inverter groups 40, where each of the multiple inverter groups 40 includes a first inverter 41 and a first non-inverter 42.

The first inverter 41 includes a first PMOS transistor B1 and a first NMOS transistor C1; and the first non-inverter 42 includes a second PMOS transistor B2 and a second NMOS transistor C2.

A control terminal of the first PMOS transistor B1 and a control terminal of the first NMOS transistor C1 are electrically connected to a third node N3; a control terminal of the second PMOS transistor B2 and a control terminal of the second NMOS transistor C2 are each electrically connected to a fourth node N4; and the third node N3 is electrically connected to the fourth node N4.

A first electrode of the first PMOS transistor B1 and a second electrode of the second NMOS transistor C2 are each electrically connected to a high-level signal terminal VGH; and a second electrode of the first PMOS transistor B1 and a first electrode of the first NMOS transistor C1 are electrically connected to a fifth node N5.

A second electrode of the first NMOS transistor C1 and a first electrode of the second PMOS transistor B2 are each electrically connected to a low-level signal terminal VGL; and a second electrode of the second PMOS transistor B2 and a first electrode of the second NMOS transistor C2 are electrically connected to a sixth node N6.

The fifth node N5 is further electrically connected to a reset control signal line IN corresponding to subpixels having a same timing in a light emission stage.

The sixth node N6 is further electrically connected to a light emission control signal line EMIT corresponding to subpixels having a same timing in a light emission stage.

In the embodiment of the present application, the inverter groups are provided, and the same gate driver circuit may be used to generate both the reset control signal and the light emission control signal. As shown in FIG. 11, the inverter group 40 may generate both the reset control signal IN and the light emission control signal EMIT. For ease of description herein, the reset control signal line and the reset control signal are both marked as IN, and the light emission control signal line and the light emission control signal are both marked as EMIT.

On the basis of the above embodiments, optionally, a width-to-length ratio $$\frac{W}{L_{B1}}$$

of the first PMOS transistor B1 is set to be greater than a width-to-length ratio $$\frac{W}{L_{C2}}$$

of the second NMOS transistor C2; and a width-to-length ratio $$\frac{W}{L_{C1}}$$

of the first NMOS transistor C1 is less than a width-to-length ratio $$\frac{W}{L_{B2}}$$

of the second PMOS transistor B2.

$$\frac{W}{L_{B1}} > \frac{W}{L_{C2}}; \frac{W}{L_{C1}} > \frac{W}{L_{B2}}.$$

In the embodiment of the present application, width-to-length ratios of MOS transistors in the inverter group are adjusted, so that a certain delay exists between the generated reset control signal and light emission control signal, that is, an output delay of the first inverter 41 is different from an output delay of the first non-inverter 42 and a driving timing shown in FIG. 7 is generated. In this way, a short circuit between the reset signal input terminal and the power signal terminal on the organic light-emitting display panel is prevented, and the generation of a large current is avoided.

Figure 12:
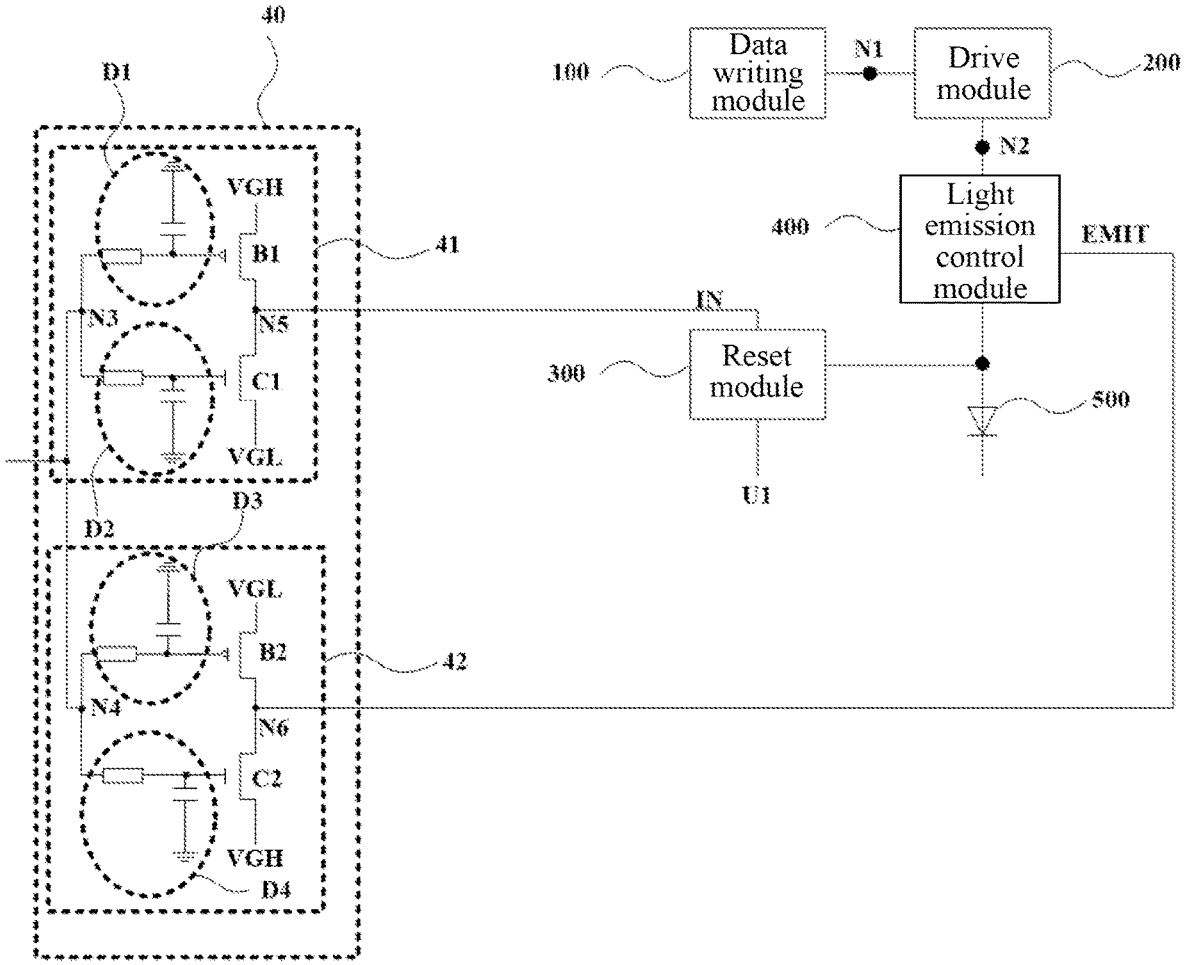
FIG. 12 is a partial structural diagram of another organic light-emitting display panel according to an embodiment of the present application.

Optionally, to make the output delay of the first inverter 41 is different from the output delay of the first non-inverter 42, as shown in FIG. 12, each inverter group may be set to further include a first resistor-capacitor (RC) circuit D1, a second RC circuit D2, a third RC circuit D3 and a fourth RC circuit D4.

The first RC circuit D1 is electrically connected between the control terminal of the first PMOS transistor B1 and the third node N3, and the second RC circuit D2 is electrically connected between the control terminal of the first NMOS transistor C1 and the third node N3. The third RC circuit D3 is electrically connected between the control terminal of the second PMOS transistor B2 and the fourth node N4, and the fourth RC circuit D4 is electrically connected between the control terminal of the second NMOS transistor C2 and the fourth node N4. A time constant $\tau_{D1}$ of the first RC circuit D1 is less than a time constant $\tau_{D3}$ of the third RC circuit D3; and a time constant $\tau_{D2}$ of the second RC circuit D2 is greater than a time constant $\tau_{D4}$ of the fourth RC circuit D4.

$$\tau_{D1}<\tau_{D3};\ \tau_{D2}>\tau_{D4}$$

The first RC circuit D1, the second RC circuit D2, the third RC circuit D3 and the fourth RC circuit D4 are adjusted to satisfy the above time constant relationship, so that the output delay of the first inverter 41 is different from the output delay of the first non-inverter 42.

Figure 13:
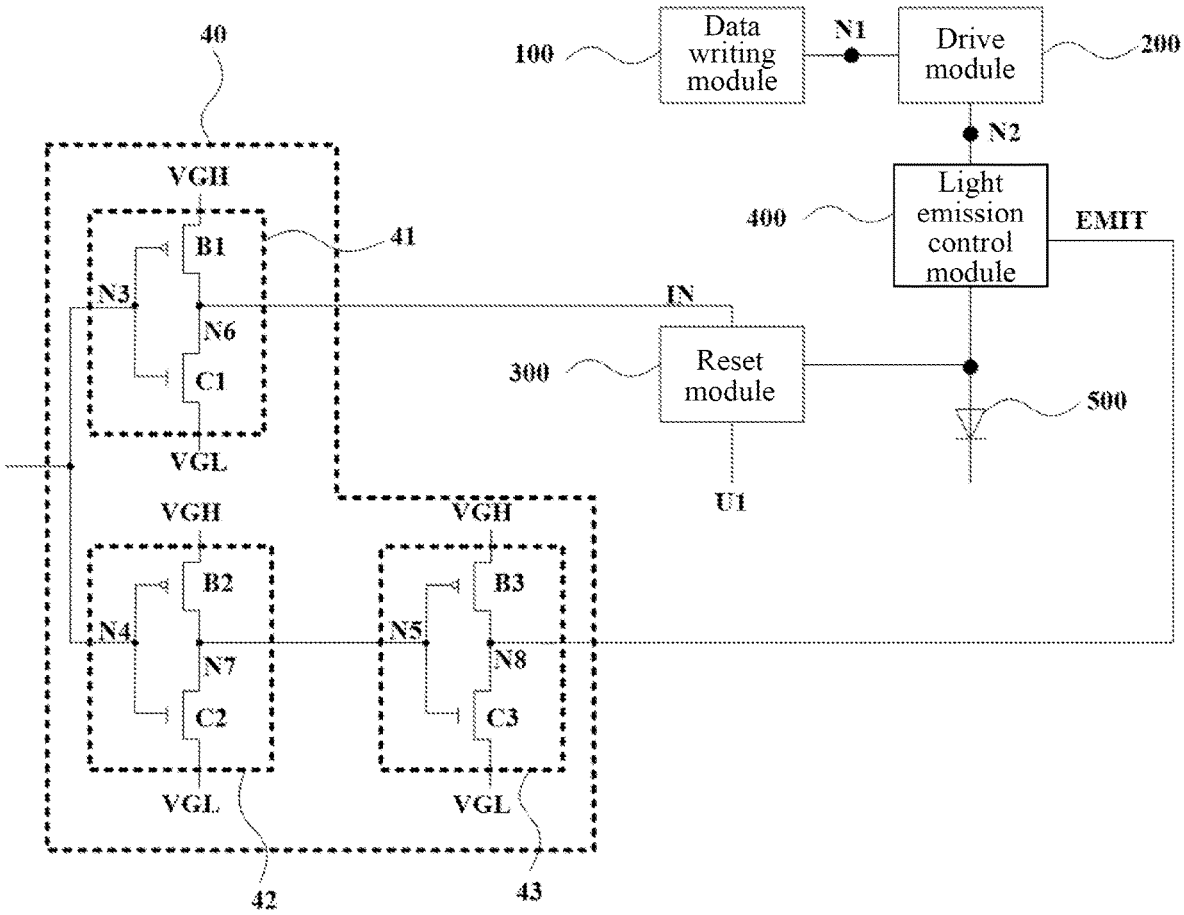
FIG. 13 is a partial structural diagram of another organic light-emitting display panel according to an embodiment of the present application.

Optionally, the embodiment of the present application further provides a partial structural diagram of an organic light-emitting display panel. As shown in FIG. 13, the organic light-emitting display panel provided by the embodiment of the present application further includes multiple inverter groups 40, where each of the multiple inverter groups 40 includes a first inverter 41, a second inverter 42 and a third inverter 43.

The first inverter 41 includes a first PMOS transistor B1 and a first NMOS transistor C1, the second inverter 42 includes a second PMOS transistor B2 and a second NMOS transistor C2, and the third inverter 43 includes a third PMOS transistor B3 and a third NMOS transistor C3. A control terminal of the first PMOS transistor B1 and a control terminal of the first NMOS transistor C1 are electrically connected to a third node N3, a control terminal of the second PMOS transistor B2 and a control terminal of the second NMOS transistor C2 are electrically connected to a fourth node N4, and a control terminal of the third PMOS transistor B3 and a control terminal of the third NMOS transistor C3 are electrically connected to a fifth node N5.

A first electrode of the first PMOS transistor B1, a first electrode of the second PMOS transistor B2 and a first electrode of the third PMOS transistor B3 are each electrically connected to a high-level signal terminal VGH. A second electrode of the first PMOS transistor B1 and a first electrode of the first NMOS transistor C1 are electrically connected to a sixth node N6. A second electrode of the first NMOS transistor C1, a second electrode of the second NMOS transistor C2 and a second electrode of the third NMOS transistor C3 are each electrically connected to a low-level signal terminal VGL. A second electrode of the second PMOS transistor B2 and a first electrode of the second NMOS transistor C2 are electrically connected to a seventh node N7. A second electrode of the third PMOS transistor B3 and a first electrode of the third NMOS transistor C3 are electrically connected to an eighth node N8. The third node N3 is electrically connected to the fourth node N4. The sixth node N6 is further electrically connected to a reset control signal line IN corresponding to subpixels having a same timing in a light emission stage. The seventh node N7 is electrically connected to the fifth node N5. The eighth node N8 is electrically connected to a light emission control signal line EMIT corresponding to subpixels having a same timing in a light emission stage.

In the embodiment of the present application, one inverter outputs the reset control signal to the reset control signal line, and two inverters connected in series output the light emission control signal to the light emission control signal line, so that the timing of the reset control signal and light emission control signal received by the same subpixel satisfies the requirements of the above embodiments.

Optionally, on the basis of the above embodiments, a sum of a charging-and-discharging time constant $t_{B2}$ of the second PMOS transistor B2 and a charging-and-discharging time constant $t_{C3}$ of the third NMOS transistor C3 may be set to be greater than a charging-and-discharging time constant $t_{B1}$ of the first PMOS transistor B1; and a sum of a charging-and-discharging time constant $t_{C2}$ of the second NMOS transistor C2 and a charging-and-discharging time constant $t_{B3}$ of the third PMOS transistor B3 is less than a charging-and-discharging time constant $t_{C1}$ of the first NMOS transistor C1.

$$t_{B1}<t_{B2}+t_{C3};\ t_{C2}+t_{B3}<t_{C1}.$$

The charging-and-discharging time constants of the MOS transistors in the first inverter 41, the charging-and-discharging time constants of the MOS transistors in the second inverter 42 and the charging-and-discharging time constants of the MOS transistors in the first inverter 43 are adjusted to satisfy the above relationship, so that the timing delay of the light emission control signal is different from the timing delay of the reset control signal.

Figure 14:
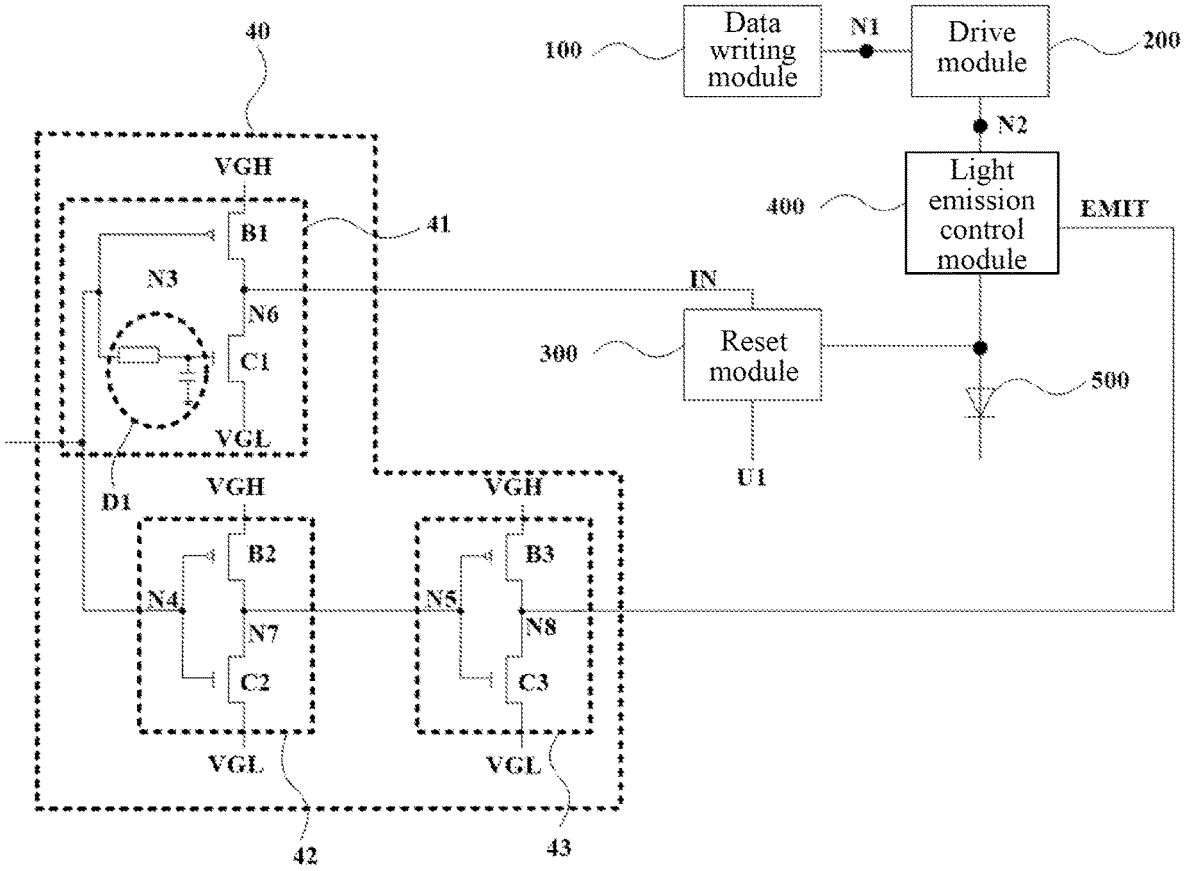
FIG. 14 is a partial structural diagram of another organic light-emitting display panel according to an embodiment of the present application.

Optionally, referring to FIG. 14, each inverter group 40 may further include a first RC circuit D1, and the first RC circuit D1 is located between the third node N3 and the control terminal of the first NMOS transistor C1.

A sum of a charging-and-discharging time constant $t_{B2}$ of the second PMOS transistor B2 and a charging-and-discharging time constant $t_{C3}$ of the third NMOS transistor C3 is greater than a charging-and-discharging time constant $t_{B1}$ of the first PMOS transistor B1; and a sum of a charging-and-discharging time constant $t_{C2}$ of the second NMOS transistor C2 and a charging-and-discharging time constant $t_{B3}$ of the third PMOS transistor B3 is less than a sum of a charging-and-discharging time constant $t_{C1}$ of the first NMOS transistor C1 and a time constant $\tau_{D1}$ of the first RC circuit D1.

$$t_{B1}<t_{B2}+t_{C3};\ t_{C2}+t_{B3}<t_{C1}+\tau_{D1}.$$

The embodiment of the present application further provides a driving method of an organic light-emitting display panel. The method is applicable to the organic light-emitting display panel of any one of the above embodiments and includes the step described below.

In at least part of a light emission stage of an i-th row of pixel units, a potential of a light emission control signal line of the i-th row of pixel units is controlled to be a first level, a potential of a light emission control signal line of a j-th row of pixel units is controlled to be a second level, a potential of a reset control signal line of the i-th row of pixel units is controlled to be a third level, and a potential of a reset control signal line of the j-th row of pixel units is controlled to be a fourth level to enable anodes of light-emitting elements of the j-th row of pixel units to be at a reset voltage and the j-th row of pixel units to be in a non-light-emission stage, so as to lead out a leakage current, where the leakage current is generated by the i-th row of pixel units through a common layer.

i and j are each a positive integer greater than or equal to 1, and the j-th row of pixel units and the i-th row of pixel units are adjacent two rows of pixel units; the first level is an effective light emission control pulse; the second level is an ineffective light emission control pulse; the third level is an ineffective reset control pulse; and the fourth level is an effective reset control pulse.

In at least part of a period during which an i-th row of pixel units are in a light emission stage, anodes of light-emitting elements of a j-th row of pixel units adjacent to the i-th row of pixel units are at a reset voltage. The anodes are reset, and the light-emitting elements do not emit light. Therefore, if a subpixel with a certain color of the i-th row of pixel units emitting light generates a leakage current to a subpixel with a different color of the adjacent j-th row of pixel units, the leakage current can be led out due to the reset voltage of the anodes of the light-emitting elements of subpixels of the j-th row of pixel units, so that crosstalk between subpixels with different colors can be avoided.

Optionally, in the embodiment of the present application, in a display period of each frame of image, light emission stages of adjacent two rows of pixel units may be controlled not to overlap. That is, in the entire light emission stage of subpixels of the i-th row of pixel units, subpixels of the j-th row of pixel units do not emit light, and anodes of light-emitting elements of the subpixels of the j-th row of pixel units are at a reset voltage, so that in a column direction, the problem is avoided of crosstalk caused by a leakage current between adjacent two subpixels with different colors in an entire light emission stage.

Optionally, it may be set that in the organic light-emitting display panel, light emission control signal lines corresponding to odd rows of pixel units are electrically connected to each other; light emission control signal lines corresponding to even rows of pixel units are electrically connected to each other; reset control signal lines corresponding to the odd rows of pixel units are electrically connected to each other; and reset control signal lines corresponding to the even rows of pixel units are electrically connected to each other; in a display period of each frame of image, the odd rows of pixel units emit light simultaneously, and the even rows of pixel units emit light simultaneously. For example, the organic light-emitting display panel is driven to emit light according to the driving timing shown in FIG. 4.

Optionally, in the embodiment of the present application, it may be controlled that odd rows of pixel units emit light row by row, and even rows of pixel units emit light row by row; and light emission stages of adjacent two odd rows of pixel units overlap, and light emission stages of adjacent two even rows of pixel units overlap. For example, the organic light-emitting display panel is driven to emit light according to the driving timing shown in FIG. 6.

Optionally, according to the driving method provided by the embodiment of the present application, it may be controlled that a display period of each frame of image includes a data writing stage and a light emission control stage. In the data writing stage of the display period of each frame of image, a plurality of rows of pixel units sequentially perform data writing; and after the data writing stage of the display period of each frame of image ends, the light emission control stage is performed. In the light emission control stage, the odd rows of pixel units emit light simultaneously, and the even rows of pixel units emit light simultaneously.

Alternatively, a display period of each frame of image includes a data writing stage and a light emission control stage. In the data writing stage of the display period of each frame of image, a plurality of rows of pixel units sequentially perform data writing; and in the light emission control stage, the odd rows of pixel units emit light row by row, and the even rows of pixel units emit light row by row. The light emission stages of the adjacent two odd rows of pixel units overlap, and the light emission stages of the adjacent two even rows of pixel units overlap.

In an embodiment, it may be controlled that a light emission control stage of a display period of a previous frame of image overlaps a data writing stage of a display period of a next frame of image.

Optionally, it may be set that the light emission control stage of a display period of each frame of image includes multiple light emission control substages; and in each of the multiple light emission control substages, the odd rows of pixel units emit light simultaneously, and the even rows of pixel units emit light simultaneously. Alternatively, in each of the multiple light emission control substages, the odd rows of pixel units emit light row by row, and the even rows of pixel units emit light row by row; and the light emission stages of the adjacent two odd rows of pixel units overlap, and the light emission stages of the adjacent two even rows of pixel units overlap.

On the basis of the above embodiments, optionally, the light emission control signal line and the reset control signal line of the same row of pixel units satisfy that: the effective light emission control pulse of the light emission control signal line and the effective reset pulse of the reset control signal line do not overlap. In this way, a short circuit between a reset signal input terminal and a power signal terminal on the organic light-emitting display panel is prevented, and thus the generation of a large current is avoided.

What is claimed is:

1. An organic light-emitting display panel, comprising: a plurality of pixel units;

wherein each of the plurality of pixel units comprises a plurality of subpixels with different colors; each of the plurality of subpixels comprises a pixel-driving circuit and a light-emitting element electrically connected to the pixel-driving circuit; the light-emitting element comprises a common layer; and common layers of adjacent light-emitting elements are disposed in a same layer and connected to each other;

for at least part of subpixel columns, adjacent two subpixels in a column direction emit different colors;

pixel-driving circuits of subpixels in a same row of pixel units are connected to a same light emission control signal line; and in a case where the light emission control signal line transmits an effective light emission control pulse, the subpixels to which the pixel-driving circuits electrically connected to the light emission control signal line belong are in a light emission stage;

the pixel-driving circuits of the subpixels in the same row of pixel units are connected to a same reset control signal line; and in a case where the reset control signal line transmits an effective reset pulse, an anode of a light-emitting element of each of the subpixels to which the pixel-driving circuits electrically connected to the reset control signal line belong is at a reset voltage, and the subpixels to which the pixel-driving circuits electrically connected to the reset control signal line belong are in a non-light-emission stage;

in a display period of each frame of image, in at least part of a period during which an i-th row of pixel units are in a light emission stage, anodes of light-emitting elements of a j-th row of pixel units are at the reset voltage to lead out a leakage current, wherein the leakage current is generated by the i-th row of pixel units through the common layer, wherein i and j are each a positive integer greater than or equal to 1, and the j -th row of pixel units and the i-th row of pixel units are adjacent two rows of pixel units; and in the display period of each frame of image, light emission stages of adjacent two rows of pixel units do not overlap.

2. The organic light-emitting display panel according to claim 1, further comprising a first scan driver circuit, a second scan driver circuit, a third scan driver circuit and a fourth scan driver circuit, wherein the first scan driver circuit comprises a plurality of cascaded first shift registers; the second scan driver circuit comprises a plurality of cascaded second shift registers; the third scan driver circuit comprises a plurality of cascaded third shift register; and the fourth scan driver circuit comprises a plurality of cascaded fourth shift registers; and light emission control signal lines corresponding to odd rows of pixel units are electrically connected to the plurality of cascaded first shift registers in one-to-one correspondence; reset control signal lines corresponding to the odd rows of pixel units are electrically connected to the plurality of cascaded second shift registers in one-to-one correspondence; light emission control signal lines corresponding to even rows of pixel units are electrically connected to the plurality of cascaded third shift registers in one-to-one correspondence; and reset control signal lines corresponding to the even rows of pixel units are electrically connected to the plurality of cascaded fourth shift registers in one-to-one correspondence.

3. The organic light-emitting display panel according to claim 1, wherein light emission control signal lines corresponding to odd rows of pixel units are electrically connected to each other, light emission control signal lines corresponding to even rows of pixel units are electrically connected to each other, reset control signal lines corresponding to the odd rows of pixel units are electrically connected to each other, and reset control signal lines corresponding to the even rows of pixel units are electrically connected to each other; and in the display period of each frame of image, the odd rows of pixel units emit light simultaneously;

and the even rows of pixel units emit light simultaneously.

4. The organic light-emitting display panel according to claim 1, wherein odd rows of pixel units emit light row by row, and even rows of pixel units emit light row by row;

and light emission stages of adjacent two odd rows of pixel units overlap, and light emission stages of adjacent two even rows of pixel units overlap.

5. The organic light-emitting display panel according to claim 4, wherein the display period of each frame of image comprises a data writing stage and a light emission control stage;

in the data writing stage of the display period of each frame of image, a plurality of rows of pixel units sequentially perform data writing; and after the data writing stage of the display period of each frame of image ends, the light emission control stage is entered; and in the light emission control stage, the odd rows of pixel units emit light simultaneously, and the even rows of pixel units emit light simultaneously.

6. The organic light-emitting display panel according to claim 5, wherein the light emission control stage of the display period of each frame of image comprises a plurality of light emission control substages; and in each of the plurality of light emission control substages, the odd rows of pixel units emit light simultaneously, and the even rows of pixel units emit light simultaneously.

7. The organic light-emitting display panel according to claim 4, wherein the display period of each frame of image comprises a data writing stage and a light emission control stage;

in the data writing stage of the display period of each frame of image, a plurality of rows of pixel units sequentially perform data writing; and in the light emission control stage, the odd rows of pixel units emit light row by row, and the even rows of pixel units emit light row by row; and the light emission stages of the adjacent two odd rows of pixel units overlap, and the light emission stages of the adjacent two even rows of pixel units overlap.

8. The organic light-emitting display panel according to claim 7, wherein a light emission control stage of a display period of a previous frame of image overlaps a data writing stage of a display period of a next frame of image.

9. The organic light-emitting display panel according to claim 7, wherein the light emission control stage of the display period of each frame of image comprises a plurality of light emission control substages; and in each of the plurality of light emission control substages, the odd rows of pixel units emit light row by row, and the even rows of pixel units emit light row by row; and the light emission stages of the adjacent two odd rows of pixel units overlap, and the light emission stages of the adjacent two even rows of pixel units overlap.

10. The organic light-emitting display panel according to claim 1, wherein the light emission control signal line and the reset control signal line of the same row of pixel units satisfy that:

the effective light emission control pulse of the light emission control signal line and the effective reset pulse of the reset control signal line do not overlap.

11. The organic light-emitting display panel according to claim 1, wherein the pixel-driving circuit comprises:

a data writing circuit, a drive circuit, a reset circuit and a light emission control module; wherein the data writing circuit and the drive circuit are electrically connected to a first node, the drive circuit and the light emission control circuit are electrically connected to a second node, the reset circuit and the light emission control circuit are each electrically connected to an anode of the light-emitting element, the reset circuit is electrically connected to a reset control signal line, and the light emission control circuit is electrically connected to a light emission control signal line; and the data writing circuit is configured to provide a data signal to the first node, the drive circuit is configured to drive the light-emitting element to emit light in a case where the light emission control circuit is turned on, and the reset circuit is configured to provide a reset signal to the anode of the light-emitting element.

12. The organic light-emitting display panel according to claim 11, wherein the light emission control circuit comprises a first transistor, the reset circuit comprises a second transistor; the first transistor is an NMOS transistor, and the second transistor is a PMOS transistor; or the second transistor is an NMOS transistor, and the first transistor is a PMOS transistor; and a light emission control signal line corresponding to each row of pixel units is further used as a reset control signal line.

13. The organic light-emitting display panel according to claim 12, wherein a current limiting resistor is connected in series between the light emission control circuit and the reset circuit.

14. The organic light-emitting display panel according to claim 1, further comprising a plurality of inverter groups, wherein each of the plurality of inverter groups comprises a first inverter and a first non-inverter;

the first inverter comprises a first PMOS transistor and a first NMOS transistor; and the first non-inverter comprises a second PMOS transistor and a second NMOS transistor;

a control terminal of the first PMOS transistor and a control terminal of the first NMOS transistor are electrically connected to a third node; a control terminal of the second PMOS transistor and a control terminal of the second NMOS transistor are each electrically connected to a fourth node;

and the third node is electrically connected to the fourth node;

a first electrode of the first PMOS transistor and a second electrode of the second NMOS transistor are each electrically connected to a high-level signal terminal; and a second electrode of the first PMOS transistor and a first electrode of the first NMOS transistor are electrically connected to a fifth node;

a second electrode of the first NMOS transistor and a first electrode of the second PMOS transistor are each electrically connected to a low-level signal terminal;

and a second electrode of the second PMOS transistor and a first electrode of the second NMOS transistor are electrically connected to a sixth node;

the fifth node is further electrically connected to a reset control signal line corresponding to subpixels having a same timing in a light emission stage; and the sixth node is further electrically connected to a light emission control signal line corresponding to the subpixels having the same timing in the light emission stage.

15. The organic light-emitting display panel according to claim 14, wherein a width-to-length ratio of the first PMOS transistor is greater than a width-to-length ratio of the second NMOS transistor; and a width-to-length ratio of the first NMOS transistor is less than a width-to-length ratio of the second PMOS transistor.

16. The organic light-emitting display panel according to claim 14, wherein the each of the plurality of inverter groups further comprises a first resistor-capacitor (RC) circuit, a second RC circuit, a third RC circuit and a fourth RC circuit;

the first RC circuit is electrically connected between the control terminal of the first PMOS transistor and the third node; and the second RC circuit is electrically connected between the control terminal of the first NMOS transistor and the third node;

the third RC circuit is electrically connected between the control terminal of the second PMOS transistor and the fourth node; and the fourth RC circuit is electrically connected between the control terminal of the second NMOS transistor and the fourth node;

a time constant of the first RC circuit is less than a time constant of the third RC circuit; and a time constant of the second RC circuit is greater than a time constant of the fourth RC circuit.

17. The organic light-emitting display panel according to claim 1, further comprising a plurality of inverter groups, wherein each of the plurality of inverter groups comprises a first inverter, a second inverter and a third inverter;

the first inverter comprises a first PMOS transistor and a first NMOS transistor; the second inverter comprises a second PMOS transistor and a second NMOS transistor; the third inverter comprises a third PMOS transistor and a third NMOS transistor; a control terminal of the first PMOS transistor and a control terminal of the first NMOS transistor are electrically connected to a third node; and a control terminal of the second PMOS transistor and a control terminal of the second NMOS transistor are electrically connected to a fourth node;

a control terminal of the third PMOS transistor and a control terminal of the third NMOS transistor are electrically connected to a fifth node; and a first electrode of the first PMOS transistor, a first electrode of the second PMOS transistor and a first electrode of the third PMOS transistor are each electrically connected to a high-level signal terminal; a second electrode of the first PMOS transistor and a first electrode of the first NMOS transistor are electrically connected to a sixth node; a second electrode of the first NMOS transistor, a second electrode of the second NMOS transistor and a second electrode of the third NMOS transistor are each electrically connected to a low-level signal terminal; a second electrode of the second PMOS transistor and a first electrode of the second NMOS transistor are electrically connected to a seventh node; a second electrode of the third PMOS transistor and a first electrode of the third NMOS transistor are electrically connected to an eighth node; the third node is electrically connected to the fourth node; the sixth node is further electrically connected to a reset control signal line corresponding to subpixels having a same timing in a light emission stage; the seventh node is electrically connected to the fifth node; and the eighth node is electrically connected to a light emission control signal line corresponding to the subpixels having the same timing in the light emission stage.

18. The organic light-emitting display panel according to claim 17, wherein a sum of a charging-and-discharging time constant of the second PMOS transistor and a charging-and-discharging time constant of the third NMOS transistor is greater than a charging-and-discharging time constant of the first PMOS transistor; and a sum of a charging-and-discharging time constant of the second NMOS transistor and a charging-and-discharging time constant of the third PMOS transistor is less than a charging-and-discharging time constant of the first NMOS transistor.

19. The organic light-emitting display panel according to claim 17, wherein the each of the plurality of inverter groups further comprises a first RC circuit; and the first RC circuit is located between the third node and the control terminal of the first NMOS transistor;

a sum of a charging-and-discharging time constant of the second PMOS transistor and a charging-and-discharging time constant of the third NMOS transistor is greater than a charging-and-discharging time constant of the first PMOS transistor; and a sum of a charging-and-discharging time constant of the second NMOS transistor and a charging-and-discharging time constant of the third PMOS transistor is less than a sum of a charging-and-discharging time constant of the first NMOS transistor and a time constant of the first RC circuit.

20. A driving method of an organic light-emitting display panel, the method being applicable to the organic light-emitting display panel of claim 1 and comprising:

in at least part of a light emission stage of an i-th row of pixel units, controlling a potential of a light emission control signal line of the i-th row of pixel units to be a first level, a potential of a light emission control signal line of a j-th row of pixel units to be a second level, a potential of a reset control signal line of the i-th row of pixel units to be a third level, and a potential of a reset control signal line of the j-th row of pixel units to be a fourth level to enable anodes of light-emitting elements of the j-th row of pixel units to be at a reset voltage and the j-th row of pixel units to be in a non-light-emission stage, so as to lead out a leakage current, wherein the leakage current is generated by the i-th row of pixel units through a common layer;

wherein i and j are each a positive integer greater than or equal to 1, and the j-th row of pixel units and the i-th row of pixel units are adjacent two rows of pixel units; the first level is an effective light emission control pulse; the second level is an ineffective light emission control pulse; the third level is an ineffective reset control pulse; and the fourth level is an effective reset control pulse.

* * * * *